United States Patent [19]

Lutz

[11] 4,395,261

[45] Jul. 26, 1983

[54] VAPOR HYDROGEN PEROXIDE BLEACH DELIVERY

[75] Inventor: Charles W. Lutz, Princeton, N.J.

[73] Assignee: FMC Corporation, Philadelphia, Pa.

[21] Appl. No.: 339,197

[22] Filed: Jan. 13, 1982

[51] Int. Cl.[3] ..... D06L 3/02; D06L 3/14; B05D 1/26

[52] U.S. Cl. ..... 8/111; 252/186.28; 206/0.5; 206/484.1

[58] Field of Search ..... 8/111; 206/0.5, 484.1; 239/53, 55, 57, 60; 252/186.28

[56] References Cited

U.S. PATENT DOCUMENTS

| | | | |
|---|---|---|---|
| 2,777,749 | 1/1957 | Young | 8/111 |
| 2,820,690 | 1/1958 | Feldmann | 8/111 |
| 2,859,087 | 11/1958 | Hawkinson et al. | 8/111 |
| 2,955,086 | 10/1960 | Hyatt | 252/99 |
| 2,955,905 | 10/1960 | Davies et al. | 8/111 |
| 3,156,089 | 11/1964 | Baumgartner et al. | 60/35.4 |
| 3,180,037 | 4/1965 | Kenreich et al. | 34/37 |
| 3,421,842 | 1/1969 | Darbee et al. | 23/60 |
| 3,574,519 | 4/1971 | Lincoln et al. | 8/111 |
| 3,627,684 | 12/1971 | Pistor | 252/99 |
| 3,671,439 | 6/1972 | Corey et al. | 252/99 |
| 3,701,202 | 10/1972 | Compa et al. | 34/72 |
| 3,706,140 | 12/1972 | Brilland et al. | 239/55 |
| 3,708,260 | 1/1973 | Marshall et al. | 8/111 |
| 3,726,967 | 4/1973 | Vorsatz et al. | 424/62 |
| 3,894,960 | 7/1975 | Gray et al. | 252/99 |
| 3,909,438 | 9/1975 | Nakagawa et al. | 252/186 |
| 3,948,387 | 4/1976 | Haertle | 206/0.5 |
| 3,957,428 | 5/1976 | Massey et al. | 8/111 |
| 3,989,638 | 11/1976 | Bradley et al. | 252/186 |
| 3,996,152 | 12/1976 | Edwards et al. | 252/186 |
| 4,011,172 | 3/1977 | Marsan et al. | 252/187 R |
| 4,017,411 | 4/1977 | Diehl et al. | 252/186 |
| 4,017,412 | 4/1977 | Bradley | 252/186 |
| 4,046,705 | 9/1977 | Yagi et al. | 252/99 |
| 4,060,385 | 11/1977 | Katz | 8/111 |
| 4,105,813 | 8/1978 | Mizuno | 252/8.8 |
| 4,114,284 | 9/1978 | Weber et al. | 34/12 |
| 4,130,392 | 12/1978 | Diehl et al. | 8/101 |
| 4,130,501 | 12/1978 | Lutz et al. | 252/186 |
| 4,166,794 | 9/1979 | Grey | 252/8.8 |
| 4,167,594 | 9/1979 | Schwadtke et al. | 206/0.5 |
| 4,223,029 | 9/1980 | Mahler et al. | 206/0.5 |
| 4,243,391 | 1/1981 | Puchta | 8/111 |
| 4,286,016 | 8/1981 | Dimond et al. | 206/0.5 |

*Primary Examiner*—Maria Parrish Tungol

*Attorney, Agent, or Firm*—Richard E. Elden; Eugene G. Horsky

[57] ABSTRACT

The invention relates to the dispensing of hydrogen peroxide into a clothes dryer. The aqueous hydrogen peroxide is placed into a container with a microporous, hydrophobic surface which is heated whereby the hydrogen peroxide is vaporized and delivered to the interior of the dryer where it is available to bleach textiles.

6 Claims, No Drawings

VAPOR HYDROGEN PEROXIDE BLEACH DELIVERY

This invention relates to the dispensing of hydrogen peroxide in the vapor phase.

It is well-known that at elevated temperatures hydrogen peroxide and other peroxygens are useful to bleach textiles. However, as the temperature of the bath is decreased, the efficiency of the bleaching drops; consequently it is not usually practical to bleach with hydrogen peroxide at temperatures of 70° C. (160° F.) or less. With the recent increase in energy costs, there has been a growing trend toward lower temperatures for washing textiles, both in home laundries and in industrial and institutional laundries. These lower temperatures are less effective for washing textiles, so it would be desirable to use a safe bleach to compensate for the lower water temperature. As a result, interest has developed in adding a safe bleach, such as hydrogen peroxide, to the clothes dryer where the heat used to dry textiles would also provide the higher temperature required to speed the bleaching action of the peroxygen chemical. For example, in U.S. Pat. No. 3,180,037 an aqueous hydrogen peroxide bleach solution is atomized into a clothes dryer. However, this method has the disadvantage in that the fine mist of hydrogen peroxide is apt to be swept out of the dryer by the air stream and wasted.

In U.S. Pat. No. 3,989,638 and U.S. Pat. No. 4,017,411 thickened hydrogen peroxide solutions are dispensed as a liquid from a porous pouch onto the surface of the textiles through the tumbling action within the clothes dryer. This method has two disadvantages: first, it has a tendency to distribute the hydrogen peroxide unevenly over the textiles; and second, it distributes most of the hydrogen peroxide onto the textiles at an early stage in the drying process, before the temperature of the dryer reaches the high temperature required for bleaching with hydrogen peroxide or other peroxygens. Alternatively, U.S. Pat. No. 4,130,392 tumbles the fabrics in the clothes dryer with a solid peroxygen activator, 1,3,4,6-tetra-acetyl glycouril plus a particulate bleaching compound, such as sodium perborate or sodium carbonate peroxide. This process has the obvious disadvantage of requiring the addition of undesirable solid particles to the clean fabrics in the dryer and can result in the buildup of such materials within the dryer or on the lint filter of the dryer. Further, such a process is even more prone to result in uneven bleaching of the textiles because of the solid particles.

According to the present invention, hydrogen peroxide is dispensed in a clothes dryer by evaporation from a container when the temperature of the dryer begins to rise. It is well-known that the boiling point of hydrogen peroxide is 150.2° C. (302.4° F.), much higher than the boiling point of water. As a result, hydrogen peroxide vapor in the dryer is condensed onto the moist fabric in a uniform manner in order to maintain the equilibrium of the hydrogen peroxide-water system. For example, at 80° C. (176° F.) 0.007 mol fraction of hydrogen peroxide in the vapor is in equilibrium with 0.1 mol fraction of hydrogen peroxide in the liquid (the damp textiles) and as the hydrogen peroxide is present in the atmosphere of the dryer as a vapor, it is not subject to the mal-distribution that characterizes the spraying or physical application methods of the prior art. In addition, an equilibrium state is maintained which tends to distribute the hydrogen peroxide throughout the entire textile mass uniformly reducing the vapor pressure of the hydrogen peroxide in the dryer atmosphere so that very little hydrogen peroxide, if any, is swept out of the dryer and wasted.

It has been found that solutions of hydrogen peroxide can be conveniently dispensed in a dryer as a vapor by diffusing through a microporous, hydrophobic membrane. Particularly suitable for this application are microporous membranes made from polypropylene with an effective pore size of 0.01 to 0.4 μm.

Although any concentration of hydrogen peroxide can be used for this invention, it is preferred for safety and convenience factors to use hydrogen peroxide concentrations of 3% to 30%. It is even more preferable for household applications to use hydrogen peroxide concentrations of 3% to 10%.

The dispenser for the hyrdrogen peroxide can be constructed in an any convenient manner. If desired, the hydrogen peroxide may be packaged within a disposable pouch formed of the microporous membrane. Such a unit is safe to ship and store as it is mechanically durable. Also, the pouch permits any oxygen formed by decomposition to vent harmlessly into the atmosphere. On the other hand, it may be convenient to utilize dispensers filled by the user and which are reusable. In this case, any simple container design is satisfactory which has a sufficient surface area for the microporous membrane together with any suitable closure.

If the container is to be used in the form of a pouch which is inserted into the loaded dryer, a particularly suitable membrane is one which is laminated between two nonwoven polypropylene webs which add the additional advantage of protecting the microporous membrane from surface abrasions in the dryer. This latter membrane is available commercially from Celanese Plastics Corporation under the trade name Celgard K-404-A microporous polypropylene engineering film. The film has an effective pore size of 0.02 μm; the pores average dimensions are 0.02×0.2 μm. The use of such a film, which retains the liquid hydrogen peroxide but permits hydrogen peroxide vapor to pass through it into the dryer, results in several other advantages. First, the hydrogen peroxide does not require a separate treatment to form a gel; second, the hydrogen peroxide may be handled as a liquid during the filling of the containers; and third, there is no foreign substance to build-up on the textiles in the dryer as in U.S. Pat. No. 4,017,411, or conversely, to build-up within the pouch or container as the hydrogen peroxide is being evaporated therefrom.

The present invention comprises a method for bleaching damp textile fabrics in a clothes dryer by means of hydrogen peroxide vapor. The hydrogen peroxide is delivered as a vapor to the interior of the dryer through a hydrophobic, vapor-permeable membrane primarily at a time when the textiles to be bleached are still damp, yet near the end of the drying cycle when the temperature within the dryer is the highest.

The bleaching process of the invention is carried out by contacting damp fabrics with an effective amount of hydrogen peroxide. It is an essential feature of this invention that the textiles to be bleached are damp when contacted by the hydrogen peroxide vapor as water provides the reaction medium for the bleaching process. The damp textiles are most commonly those secured by washing, rinsing, and spin drying the textiles in any standard washing machine. Such textiles normally contain from about 50% to 250% by weight of water based on the dry textile weight. As the rate of evaporation of the hydrogen peroxide from the container is not appreciable until the temperature begins to rise, the present invention retards the addition of the hydrogen peroxide until the water content of the textile drops substantially to less than the amount normally obtained from the spin drying step of the washer. The present invention, therefore, delivers the hydrogen peroxide at the time when the temperature is rising and the bleaching action is more effective and at the time when less moisture is on the textiles to dilute the hydrogen peroxide. Therefore, the hydrogen peroxide may be used more efficiently.

EXAMPLE 1

Two, 2.2 kg (5 pound) wash loads of tea-stained swatches and white filler fabrics were laundered without a detergent for 14 minutes at 40° C. Each load was then dried in an electric dryer for 40 minutes. In case 1A, a pouch made of a microporous film containing 40 g of 10% hydrogen peroxide solution was added to the dryer. After 40 minutes drying time, the pouch had lost 6 g and had formed a gas-filled "pillow", indicating delivery of contents by means of the vapor state. Tea-stained swatches in the case 1A wash load were uniformly bleached and were visibly lighter in color than were the swatches dried in the absence of the bleach, case 1B.

The incremental change of reflectance of the bleached cotton fabric of case 1A was 1.3% compared with 0.7% for unbleached fabrics of case 1B. The incremental change in reflectance for fabric blends of 35% cotton and 65% polyester was 1.2% for the bleached fabrics of case 1A and 0.7% for the unbleached fabrics of case 1B.

I claim:

1. A method for bleaching damp textiles while they are exposed to heated gases in a clothes dryer by means of hydrogen peroxide initially confined as a liquid by the inner surface of a wall of a container, at least part of said wall being a microporous, hydrophobic membrane having an effective pore size of approximately 0.01 μm to 0.4 μm in size with the exterior surface thereof accessible to the heated gases of the dryer whereby said liquid hydrogen peroxide is vaporized by the heat of said gases and delivered as a vapor through said membrane into the heated gases of the dryer primarily at a time when the textiles to be bleached are still damp, yet near the end of the drying cycle when the temperature within the dryer is the highest.

2. The method of claim 1, wherein the container is a pouch formed from said surface, and said microporous membrane is a polypropylene film.

3. The method of claim 2, wherein the said surface consists of said membrane laminated to at least one polypropylene non-woven web and said pores are $0.02 \times 0.2$ μm in size.

4. The method of claim 1, wherein the hydrogen peroxide concentration is between 3% and 30%.

5. The method of claim 1, wherein the hydrogen peroxide concentration is between 3% and 10%.

6. A package for insertion into a clothes dryer comprising a wall defining the outer surface of a closed container, the inner surfaces of said wall confining a liquid, aqueous solution of 3% to 10% hydrogen peroxide, at least part of said wall being a hydrophobic, vapor-permeable membrane having an effective pore size of approximately 0.01 μm to 0.4 μm in size.

* * * * *